US006290457B1

(12) United States Patent
Kabasawa et al.

(10) Patent No.: US 6,290,457 B1
(45) Date of Patent: Sep. 18, 2001

(54) VACUUM PUMP

(75) Inventors: Takashi Kabasawa; Manabu Nonaka, both of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/537,939

(22) Filed: Mar. 29, 2000

(30) Foreign Application Priority Data

Mar. 31, 1999 (JP) ..... 11-091302

(51) Int. Cl.[7] ..... F01D 1/36
(52) U.S. Cl. ..... 415/90; 415/222; 417/423.4
(58) Field of Search ..... 415/90, 143, 220, 415/222; 417/423.4

(56) References Cited

U.S. PATENT DOCUMENTS 5,618,167 * 4/1997 Hirakawa et al. ..... 417/372
5,688,106 * 11/1997 Cerruti et al. ..... 415/90
5,695,316 * 12/1997 Schutz et al. ..... 415/90
5,924,841 * 6/1999 Okamura et al. ..... 415/90
5,971,725 * 10/1999 de simon et al. ..... 417/423.8

* cited by examiner

*Primary Examiner*—Edward K. Look
*Assistant Examiner*—James M McAleenan
(74) *Attorney, Agent, or Firm*—Adams & Wilks

(57) ABSTRACT

A vacuum pump has a rotor body having multiple stages of rotor blades each comprising a plurality of open-ended blades. The uppermost rotor blade formed on the rotor body is located in a position corresponding to a conical portion in a casing. The tip end of the rotor blade is inclined at the same angle as an inclination angle of the conical portion. Accordingly, gas molecules accelerated at the tip end of the rotor blade in a gas molecular region are unlikely to impinge on the casing, and are prevented from staying so that deterioration in discharge capabilities at the tip end can be suppressed. The uppermost rotor blade is located at the conical portion, making it possible to effectively transport the gas molecules toward the outer periphery of the second and following rotor blades.

11 Claims, 8 Drawing Sheets

VACUUM PUMP

BACKGROUND OF THE INVENTION

1. Field of the Invention

The present invention relates to a vacuum pump, and more specifically to a vacuum pump having rotor blades arranged on an inlet port side.

2. Description of the Related Art

Vacuum pumps are widely used in, for example, systems for discharging a gas within a chamber and for evacuating the chamber in semiconductor production devices. Such vacuum pumps include those entirely comprised of blades and those comprised of blades and thread groove portions.

FIGS. 6A–6C depict the structures of conventional vacuum pumps. FIG. 6A is a top plan view showing part of a conventional vacuum pump, FIG. 6B is a partial cross-sectional view showing a conventional vacuum pump with a straight inlet port, and FIG. 6C is a partial cross-sectional view showing a conventional vacuum pump with a constricted inlet port.

These vacuum pumps comprise a stator 70 fixed to an interior of a casing 10, and a rotatable rotor 60. The stator 70 and the rotor 60 are formed with axially stepped portions of blades, constituting a turbine.

In vacuum pumps having such a structure, the rotor 60 is rapidly rotated with a motor at several tens of thousand rpm under a normal state, so that the vacuum pumps may be evacuated (exhausted).

Such vacuum pumps are used to discharge gas molecules in such a manner whereby rotation of the rotor 60 allows the gas molecules sucked from an inlet port 16 to be struck in a direction of rotation of rotor blades 62. Depending upon the difference between an amount of the molecules flowing toward the outlet port 17 and the amount of molecules flowing back to the inlet port 16 from the outlet port 17 due to a pressure difference between the inlet port 16 and the outlet port 17, a final discharge amount, i.e., a discharge capability of the pump is determined.

However, the gas molecules within a molecular flow region are reflected in a direction perpendicular with respect to an impinging wall surface (impinging surface) regardless of an angle incident to the wall surface. This urges most of the molecules accelerated in the vicinity of the tip ends of the rotor blades 62 to advance in its tangential direction (a direction vertical to the rotor blades 62). On the other hand, the inner wall of the casing 10 is shaped into a cylinder, and is expanded in a direction of advancing the molecules (tangential direction) depending upon its curvature. Therefore, the gas molecules impinging on the tip ends of the rotor blades 62 may often impinge on the inner wall of the casing 10.

If portions where the rotor blades 62 are arranged have axially constant inner diameters in the casing 10, most of the molecules that accelerate in the vicinity of the tip ends of the rotor blades 62 then impinge on the casing 10, and are reflected in a direction vertical to the wall surface of the casing 10, thereby decelerating in flowing directions. This causes the gas molecules that decelerate in flowing directions (an axial direction) to stay in the vicinity of the tip ends of the rotor blades 62, thereby reducing the discharge flow rate along with a partially increased pressure. This deteriorates discharge capabilities.

This tends to occur at the uppermost rotor blade to which no certain momentum in a discharge direction is yet applied by the rotor blades 62 or in the vicinity of the tip end of the second rotor blade 62 with less momentum.

Consider a turbomolecular pump of the type shown in FIG. 6C, in which the inner diameter of the casing is narrowed at the inlet port side so as to be constricted to a predetermined bore size at the inlet port side (an upstream side) above the uppermost rotor blade 62 in order to attach the casing to a flange with a smaller bore size than the outer diameter of the rotor blades. The gas molecule flow in a molecular flow region is highly straightforward while the gas molecules enter only into substantially the same range as the port size of the inlet port 16. Therefore, the uppermost rotor blade 62 has the problem that the gas molecules are not likely to flow around its tip end (outer peripheral side) with a high flow rate and high discharge efficiency. Hence, the tip end of the uppermost rotor blade 62 is dead space for the gas molecules introduced from the inlet port 16, resulting in less discharging of the gas molecules from the inlet port, and is often used to prevent backflow. The discharging effects are deteriorated.

In order to avoid such disadvantages, it is conceivable that a change ratio of the inner diameter of the constriction of the casing 10 is reduced to increase the gas molecules flowing around the tip end of the uppermost rotor blade 62 from the inlet port. However, an increased distance from the inlet port 16 to the uppermost rotor blade 62 brings less conductance, resulting in no improved discharge rate (effective discharge rate) at the inlet port 16 of the pump.

SUMMARY OF THE INVENTION

The present invention has been made in order to solve the above problems associated with aforementioned conventional vacuum pumps, and an object of the present invention is to provide a vacuum pump with less loss at the tip ends of rotor blades arranged on an inlet port side so that the discharge capabilities may be enhanced.

The present invention provides a vacuum pump comprising: a casing having an inlet port for sucking a gas; rotatable rotor blades arranged in multiple stages and received in the casing; and stator blades fixed between the rotor blades, the rotor blades being rotated to transport the gas, wherein the casing includes a cylindrical portion having a larger inner diameter than the inner diameter of the inlet port and a conical portion continuously connecting the cylindrical portion to the inlet port, and wherein each of the rotor blades comprises a plurality of blades extending radially outwardly such that an uppermost rotor blade of the above-described multiple rotor blades on the inlet port side is located in a position corresponding to the conical portion, thus attaining the above object.

Further according to the vacuum pump of the present invention, the shape of the radially outward end of the uppermost rotor blade is inclined at the same angle as an inclination angle of the conical portion.

Still further according to the vacuum pump of the present invention, a second rotor blade of the above-described multiple rotor blades is further located in a position corresponding to the conical portion.

Still further according to the vacuum pump of the present invention, the rotor blade is located so that an upper portion on the inlet port side than a center of the rotor blade in a vertical direction is positioned in the conical portion.

BRIEF DESCRIPTION OF THE DRAWINGS

Other features and advantages of the present invention will be apparent from the following detailed description with reference to the accompanying drawings, in which.

DETAILED DESCRIPTION OF THE PREFERRED EMBODIMENTS

The preferred embodiments of the present invention will now be described in detail with reference to the accompanying drawings.

Figure 1:
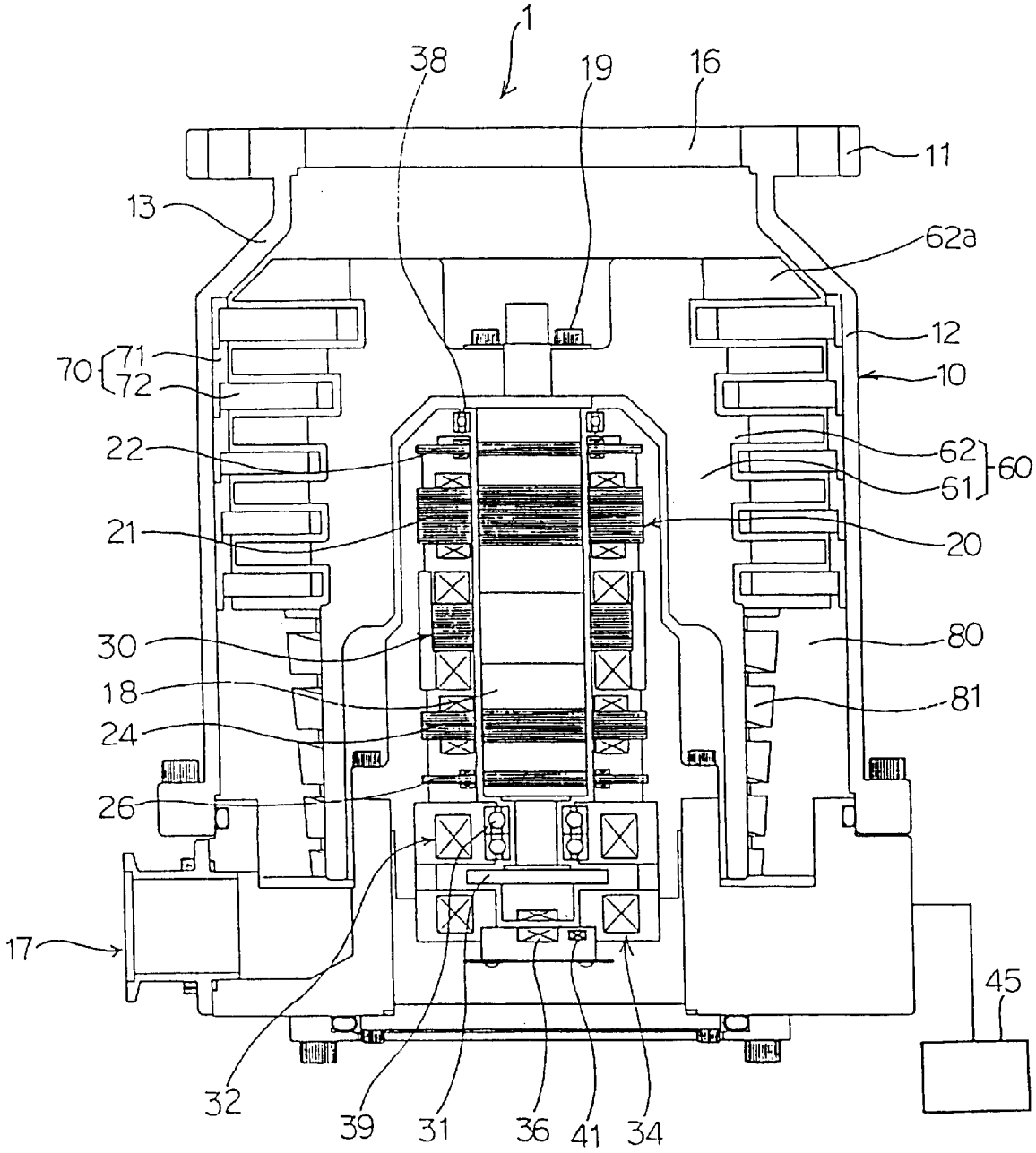
FIG. 1 is a cross-sectional view showing the whole structure of a vacuum pump in accordance with an embodiment of the present invention.

FIG. 1 is a cross-sectional view showing the whole structure of a vacuum pump in accordance with an embodiment of the present invention.

The vacuum pump 1 is disposed in a semiconductor production device or the like and is operable to discharge a process gas from a chamber etc.

As seen in FIG. 1, the vacuum pump 1 comprises a casing 10 shaped into substantially a cylinder, a rotor shaft 18 shaped into substantially a column and arranged in the casing 10, a rotor 60 and a stator 70. The rotor 60 is fixed to the rotor shaft 18 and rotated with the rotor shaft 18.

The casing 10 has a flange 11 at the top end which extends outwardly in the radial direction. The flange 11 is secured to a semiconductor production device or the like by using bolts etc. to connect an inlet port 16 formed within the flange 11 to an outlet port of a container such as a chamber so that the inside of the container may be communicated to the inside of the casing 10.

The casing 10 further includes a cylindrical portion 12 and a conical portion 13. The inner diameter of the cylindrical portion 12 (here, equivalent to the inner diameter of a spacer 71) is larger than the inner diameter of the inlet port 16 formed in the flange 11. The conical portion 13 also serves to constrict the cylindrical portion 12 with a large diameter so that the flange 11 may match the outlet port of a chamber etc.

The rotor 60 includes a rotor body 61 substantially reverse U-shaped in section and arranged on the outer periphery of the rotor shaft 18. The rotor body 61 is fixed to the top of the rotor shaft 18 by using bolts 19. The rotor body 61 is formed with multiple stages of rotor blades 62 on an outer periphery. Each of the rotor blades 62 comprises a plurality of open-ended blades.

According to the present embodiment, the uppermost rotor blade 62*a* formed on the rotor body 61 is located in a position corresponding to the conical portion 13. The tip end of the rotor blade 62*a* is formed to be inclined at the same angle as an inclination angle of the conical portion 13 so that axial and diametric intervals between the rotor blade 62*a* and the conical portion 13 may be constant.

The stator 70 comprises spacers 71, and stator blades 72 supported at the outer periphery by the spacers 71, 71 and arranged between the respective stages of rotor blades 62.

The spacers 71 are cylindrical having stepped portions, and are stacked within the casing 10.

The vacuum pump 1 further comprises a magnetic bearing 20 for magnetically supporting the rotor shaft 18, and a motor 30 for providing the rotor shaft 18 with a torque.

The magnetic bearing 20 is a five-axis magnetic bearing, comprising radial electromagnets 21, 24 for providing the rotor shaft 18 with radial magnetic force, radial sensors 22, 26 for detecting radial positions of the rotor shaft 18, axial electromagnets 32, 34 for providing the rotor shaft 18 with axial magnetic force, an armature disk 31 activated by the axial magnetic force caused by the axial electromagnets 32, 34, and an axial sensor 36 for detecting axial positions of the rotor shaft 18.

The radial electromagnet 21 is made up of two pairs of electromagnets orthogonal to each other. Each pair of electromagnets face via the rotor shaft 18 and are arranged in a position above the motor 30 of the rotor shaft 18.

Two pairs of radial sensors 22 facing via the rotor shaft 18 are disposed above the radial electromagnet 21. The two pairs of radial sensors 22 are orthogonal to each other so as to correspond to the two pairs of radial electromagnets 21.

Two pairs of radial electromagnets 24 orthogonal to each other are also disposed in a position below the motor 30 of the rotor shaft 18.

Also, two pairs of radial sensors 26 are disposed below the radial electromagnets 24 so as to be adjacent to the radial electromagnets 24.

A magnetizing current is supplied to the radial electromagnets 21, 24 to thereby magnetically float the rotor shaft 18. The magnetizing current is controlled in response to a position detecting signal from the radial sensors 22, 26 when the rotor shaft 18 is magnetically floated. Accordingly, the rotor shaft 18 can be held at a predetermined position in the radial direction.

The disc-like armature disk 31 made of magnetic material is fixed to the lower portion of the rotor shaft 18, and the pair of axial electromagnets 32, 34 facing via the armature disk 31 are also disposed at the portion of the lower rotor shaft 18. Further, the axial sensor 36 is disposed facing the lower end of the rotor shaft 18.

The magnetizing currents of the axial electromagnets 32, 34 are controlled in response to a position detecting signal from the axial sensor 36 so that the rotor shaft 18 can be held at a predetermined position in the axial direction.

The magnetic bearing 20 comprises a magnetic bearing control unit (not shown) serving as a controller 45. The magnetic bearing control unit feedback-controls the magnetizing currents of the radial electromagnets 21, 24, the axial electromagnets 32, 34 and the like based on detection signals of the radial sensors 22, 26 and the axial sensor 36, respectively, so that the rotor shaft 18 can be magnetically floated.

Therefore, the vacuum pump 1 according to the present embodiment using a magnetic bearing can be driven in a clean environment such that no dust occurs because of no existence of mechanical contact portions and no gas occurs because of no requirement for sealing oil etc. Such a vacuum pump is suitably used in a semiconductor production and the like device with requirement of high cleanliness.

The vacuum pump 1 according to the present embodiment includes protection bearings 38, 39 at upper and lower portions of the rotor shaft 18, respectively.

Typically, a rotor unit comprising the rotor shaft 18 and components incorporated therewith is borne in a non-contact manner by the magnetic bearing 20 while being rotated with the motor 30. The protection bearings 38, 39 in place of the magnetic bearing 20 bear the rotor unit when a touch down occurs, thereby protecting the whole device.

Therefore, the protection bearing 38, 39 are arranged so that the inner races may not be brought into contact with the rotor shaft 18.

The motor 30 is disposed between the radial sensor 22 and the radial sensor 26 inside the casing 10 and substantially at the center in the axial direction of the rotor shaft 18. The motor 30 is energized to rotate the rotor shaft 18 and the rotor 60 and the rotor blades 62 fixed thereto. The rotational speed of the rotor 60 is detected by an rpm sensor 41, and is then controlled by a controller based on the signal from the rpm sensor 41.

An outlet port 17 for discharging a gas to the outside is formed in the lower portion of the casing 10 of the vacuum pump 1.

The vacuum pump 1 is connected to a controller via connectors and cables.

Next, the operation of the thus constructed vacuum pump in accordance with the present embodiment will be described.

The movement of gas molecules is described with reference to FIG. 2.

Figure 2:
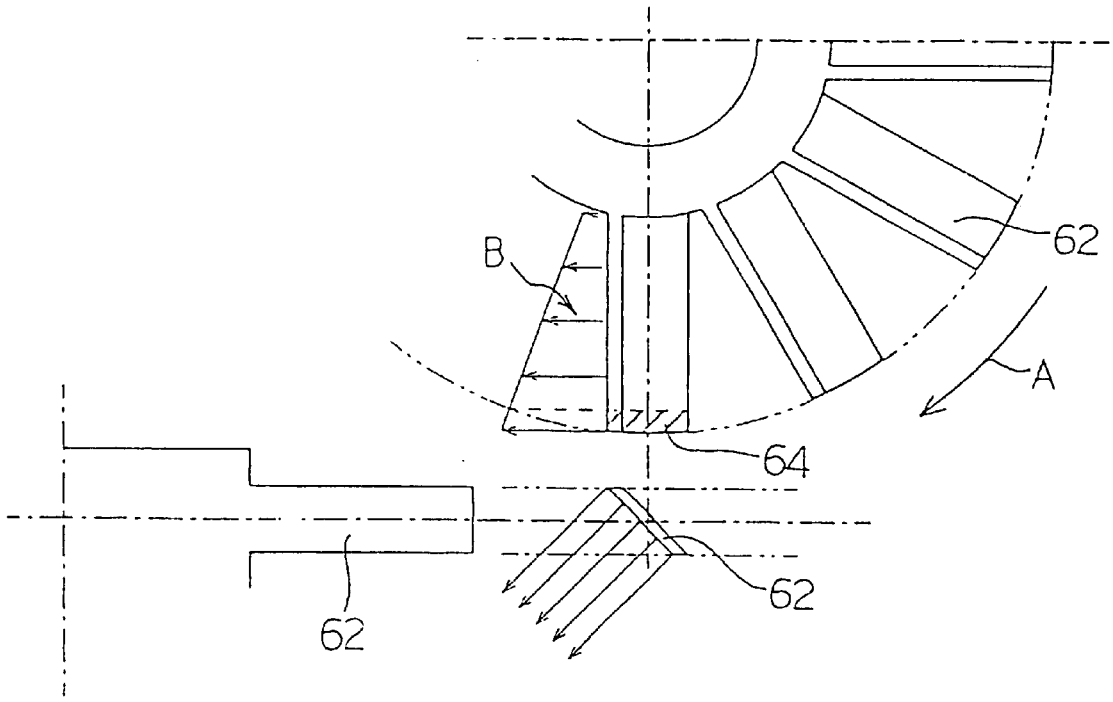
FIG. 2 is explanatory view showing directions of accelerating gas molecules that impinge on rotor blades in the vacuum pump of FIG. 1.

Referring now to FIG. 2, as the rotor blades 62 rotate at a high rate in the direction indicated by an arrow A (right-handed direction of the rotor blades 62 as viewed from the inlet port side), the rotor blades 62 allow the gas molecules to accelerate in a normal direction indicated by arrows B. The gas molecules accelerate in a direction vertical to the surfaces of the rotor blades 62 as shown in FIG. 2, resulting in acceleration in a normal direction and a downstream direction (discharge direction) relative to the rotor blades 62.

The gas molecules impinging on the tip ends of the rotor blades 62 as shaded in FIG. 2 impinge on the casing 10 circular in section (indicated by a double-dot line).

However, as seen in FIG. 2, the gas molecules accelerated by the momentum component of the downstream direction are still reflected mainly in a direction vertical to the wall surface after impinging on the wall surface. Then, the gas molecules obtain the velocity component of a direction vertical to the wall surface.

In the vacuum pump according to the present embodiment, as depicted in FIG. 1, the uppermost rotor blade 62*a* is located in a position corresponding to the conical portion 13, and the casing may not be expanded in a normal direction. The gas molecules accelerated at the tip end of the rotor blade 62*a* are thus unlikely to impinge on the casing, facilitating their arrival at downstream blades. Even when impinging on the casing, the gas molecules impinge on the conical portion 13 having an inner peripheral surface inclined to the axial downstream, so that the gas molecules also vertically move at a rate in a downstream direction within a molecular flow region. This prevents the gas molecules from staying in the vicinity of the tip end of the rotor blade 62*a*, thus improving the discharge capabilities.

The uppermost rotor blade 62*a* in the present embodiment is arranged at a conical portion 13, which makes it possible to prevent the molecules having the velocity component in an outward diameter direction from impinging on the wall surface. Therefore, the gas molecules that enter into substantially the same range as the area of the inlet port 16 can be actively accelerated outwardly of the diameter direction. Then, the gas molecules from the inlet port 16 can also move toward the tip ends of the second and following rotor blades 62 facing the cylindrical portion 12. In this way, the rotor blade 62*a* is located in a position corresponding to the conical portion 13, eliminating any dead space for the gas molecules introduced from the inlet port 16 so that the gas molecules can be effectively discharged without reduced conductance.

Figure 3:
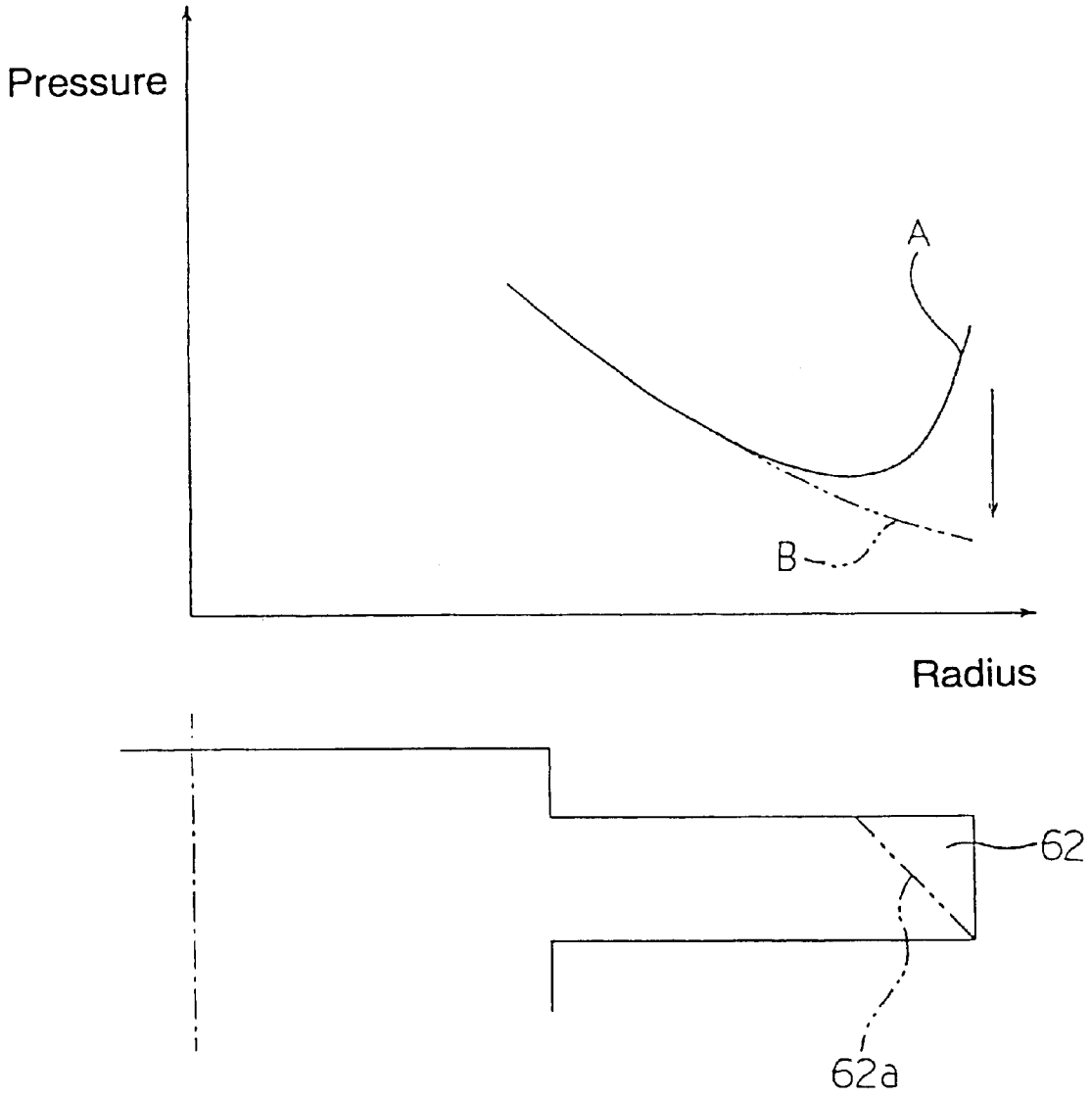
FIG. 3 is explanatory view showing a relationship between a radial position of the uppermost rotor blade and a pressure in the vacuum pump of FIG. 1.

FIG. 3 depicts a relationship between a radial position of the uppermost rotor blade and a pressure in the vacuum pump. In FIG. 3, pressure is expressed by the y-axis and the radius of the rotor blade originating from the axial center is expressed by the x-axis. Also FIG. 3 shows the shape of the rotor blades, illustrating the radial shape of the uppermost rotor blade 62*a* arranged at the cylindrical portion 12 and the radial shape of the uppermost rotor blade 62*a* arranged at the conical portion 13.

As seen in FIG. 3, if the uppermost rotor blade 62*a* is arranged at the cylindrical portion 12, the rotor blades 62 have increased peripheral speed as extending outwardly in the radial direction (as the radius is made larger), as indicated by a solid line A. Then, discharge efficiency is enhanced, thus gradually reducing a pressure. However, the gas molecules that impinge on the inner wall of the cylindrical portion 12 in the casing 10 to lose the momentum component of a downstream direction stay at the tip ends of the rotor blades 62. Hence, a pressure increases to the contrary.

In contrast to this, the gas molecules accelerated at the tip end of the uppermost rotor blade 62*a* according to the present embodiment are unlikely to impinge on the casing 10, and reflected in the downstream direction at the conical portion 13 and do not stay even if impinging thereon. Thus, a pressure decreases at the tip end of the rotor blade 62*a* as indicated by a double-dot line B of FIG. 3.

The rotor blade 62*a* according to the present embodiment enables the backflow rate of the gas molecules to be further reduced by inclining the tip end of the rotor blade 62*a* at the same angle as an inclination angle of the conical portion 13 so that axial and diametric intervals between the rotor blade 62*a* and the conical portion 13 may be constant.

As described a above, according to the pre sent embodiment, the discharge efficiency can be improved at the tip end of the uppermost rotor blade 62*a*.

That is to say, the tip end of the rotor blade 62*a* can be expected for discharge capabilities due to highest peripheral speed. However, conventional pumps encounter inconvenience that the molecules accelerated at this portion impinge on the inner wall of the casing with increased loss due to decreased velocity in the flowing direction.

On the contrary, according to the present embodiment, the conical portion 13 inclined toward the downstream is disposed in the casing 10 so as to be parallel to or external to the movement direction of the accelerated molecules, and in a position corresponding thereto, the uppermost rotor blade 62*a* is located. Then, the molecules are unlikely to impinge on the casing 10. Furthermore, even if the molecules accelerated in the vicinity of the tip end impinge on the inner wall of the conical portion 13, the molecules are reflected toward the downstream, thus continuing movement toward the downstream. Therefore, the molecules can be prevented from staying at the tip end of the rotor blade 62*a* (increased pressure), thus improving discharge capabilities.

Moreover, the uppermost rotor blade 62*a* is located at the conical portion 13 in the casing 10 at which no rotor blade is located in the prior art, making it possible to effectively transport the molecules to the outer periphery of the second and following rotor blades 62. This effect is enhanced in particular in a molecular flow region having a high mean free path and high straightforwardness of molecules.

If the top surface of the rotor blade 62*a* is so designed to be located right under the inlet port 16, conductance between the inlet port 16 and the rotor blade 62*a* can be increased, thus increasing the probability of drawing in the molecules.

As a consequence, according to the vacuum pump of the present embodiment, remarkable deterioration of the discharge capabilities can be avoided even if the inlet port is constricted, improving discharge capabilities as compared with conventional pumps having the same port size.

While the present invention has been described in conjunction with the preferred embodiment, the present invention is not to be limited to the constitution of the foregoing embodiment, but other embodiments or modifications may be employed without departing from the scope of the invention set forth in the appended claims.

For example, one stage of the rotor blade 62*a* is located at the conical portion 13 in the aforementioned embodiment; however, the vacuum pump according to the present invention may employ two stages of the rotor blades 62 which are located at the conical portion 13. In this case, the uppermost stator blade 72 may be positioned between the uppermost rotor blade 62*a* and the second rotor blade, or otherwise, the uppermost stator blade 72 may be positioned below (at the downstream side of) the second rotor blade.

Further, in the aforementioned embodiment, the rotor blade 62*a* is located in a position corresponding to the conical portion 13, and is inclined at the same angle as an inclination angle of the conical portion 13 across the height of the tip end.

Figure 4:
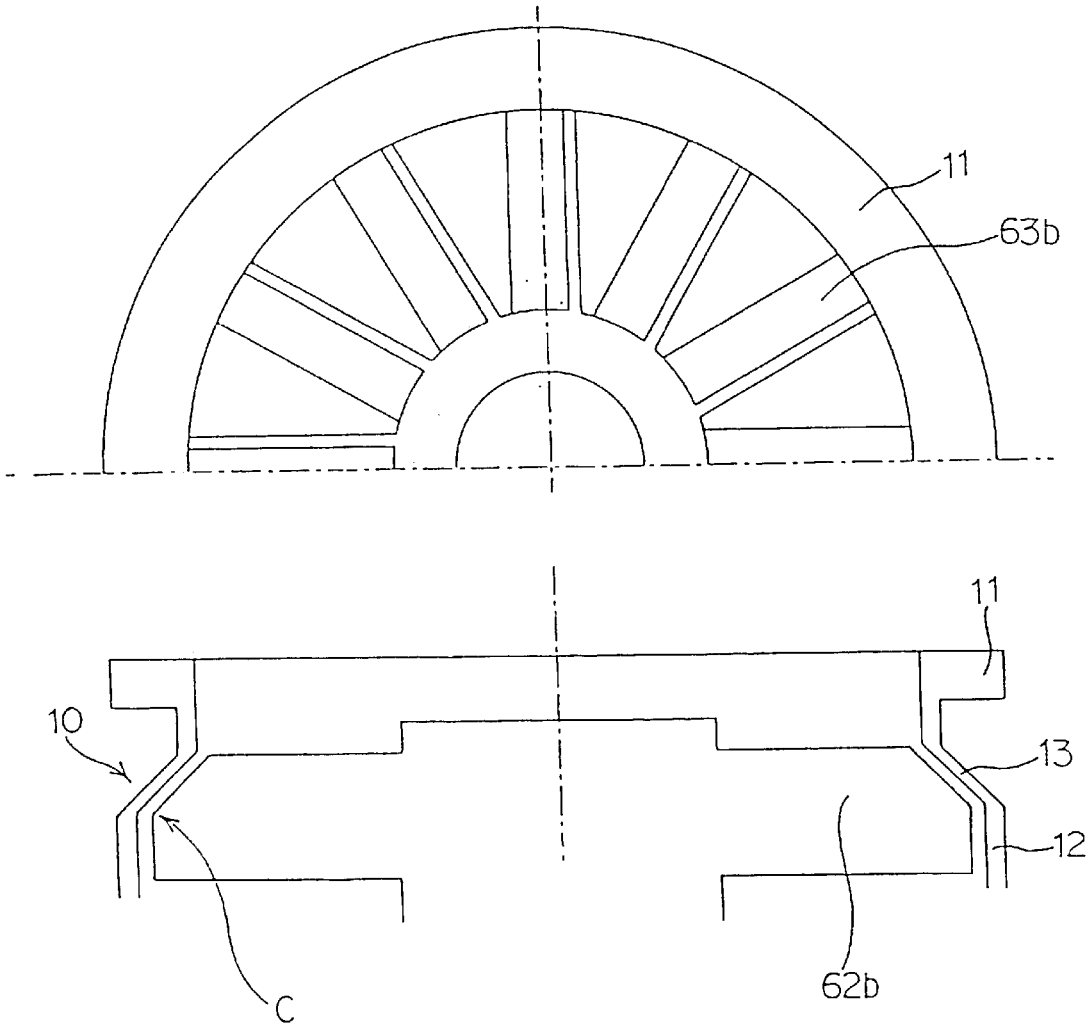
FIG. 4 is view showing the configuration of the uppermost rotor blade in accordance with a modified embodiment of the present invention.

However, in the present invention, as shown in FIG. 4, the center of the uppermost rotor blade 62*b* in a vertical direction (indicated by an arrow C of FIG. 4) may be positioned at the joint of the cylindrical portion 12 and the conical portion 13, and a upper half portion (the inlet port side) than the center facing the conical portion 13 may be inclined at the same angle as an inclination angle of the conical portion 13.

Figure 5:
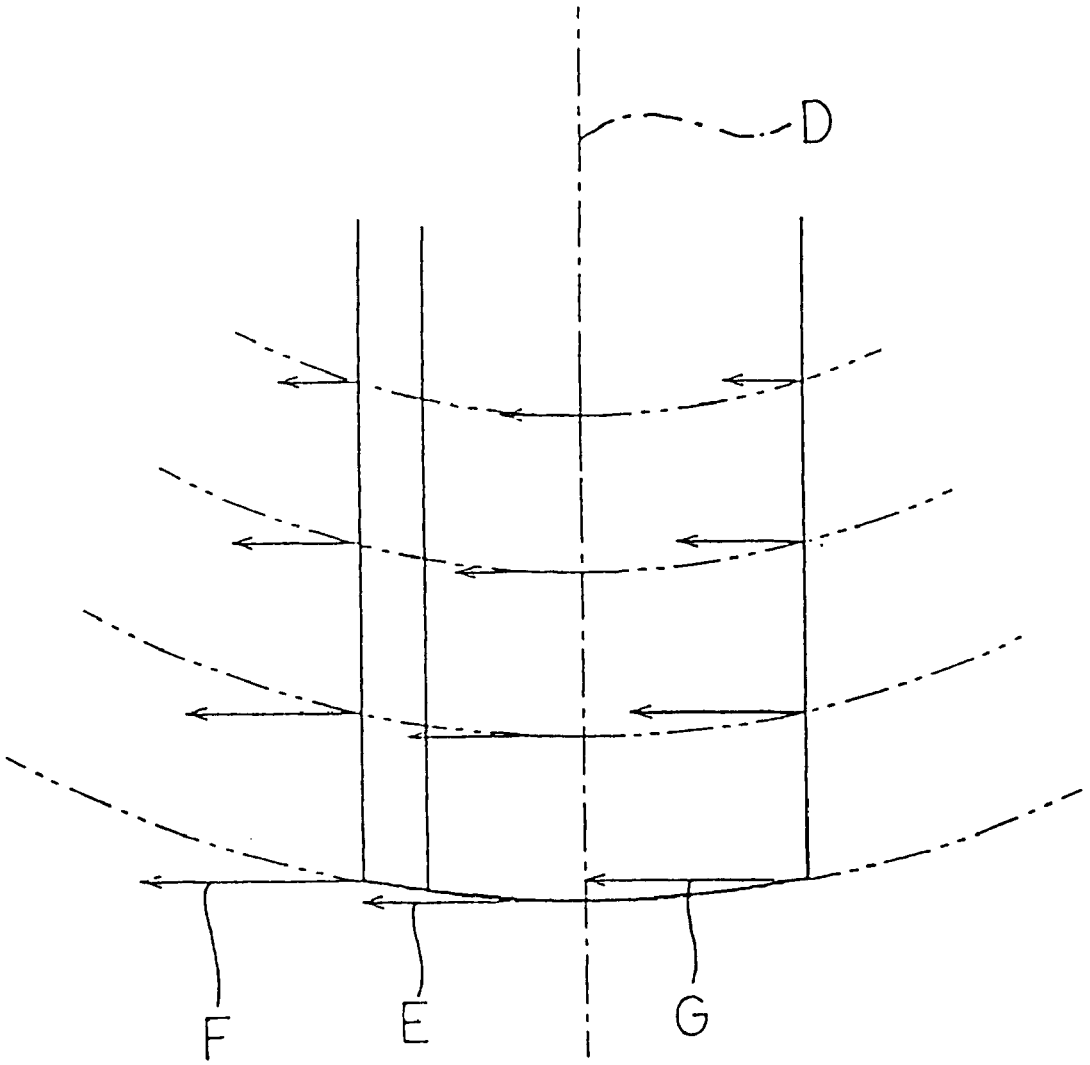
FIG. 5 is an explanatory view showing a movement of gas molecules in accordance with the modified embodiment shown in FIG. 4.
Figure 6A:
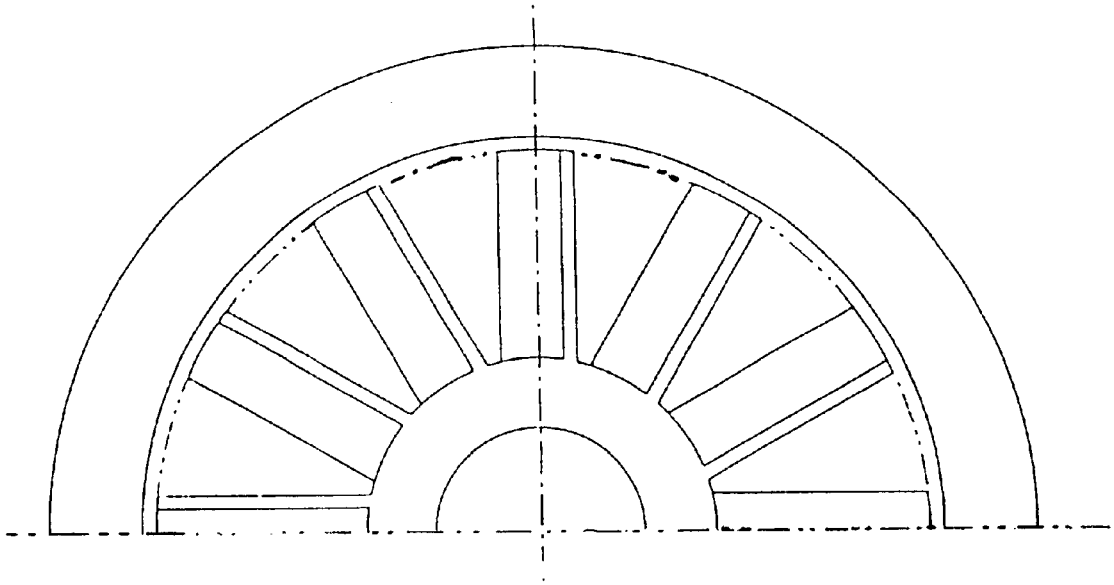
FIG.6A PRIOR ART
FIGS. 6A to 6C are views showing the structures of conventional turbomolecular pumps.
Figure 6B:
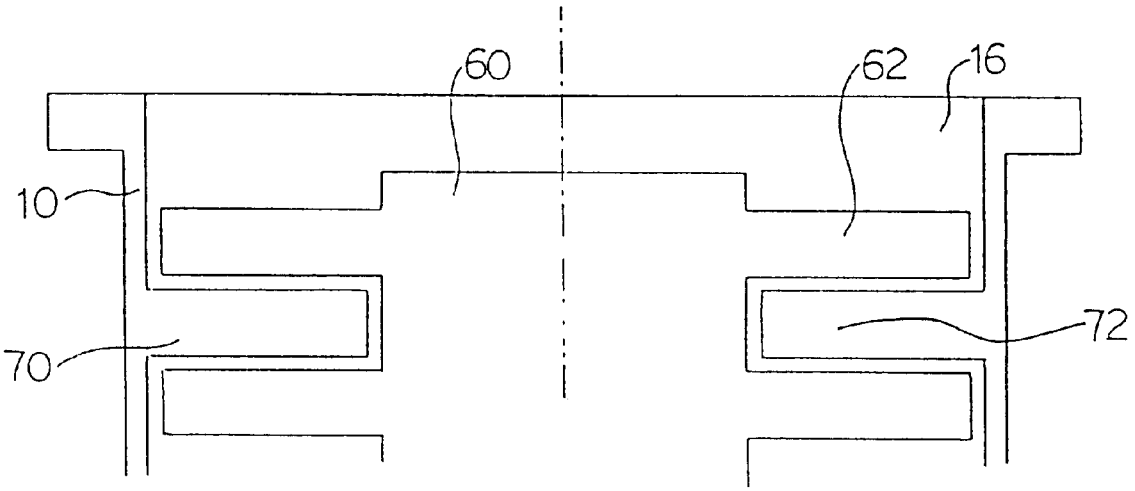
FIG.6B PRIOR ART
Figure 6C:
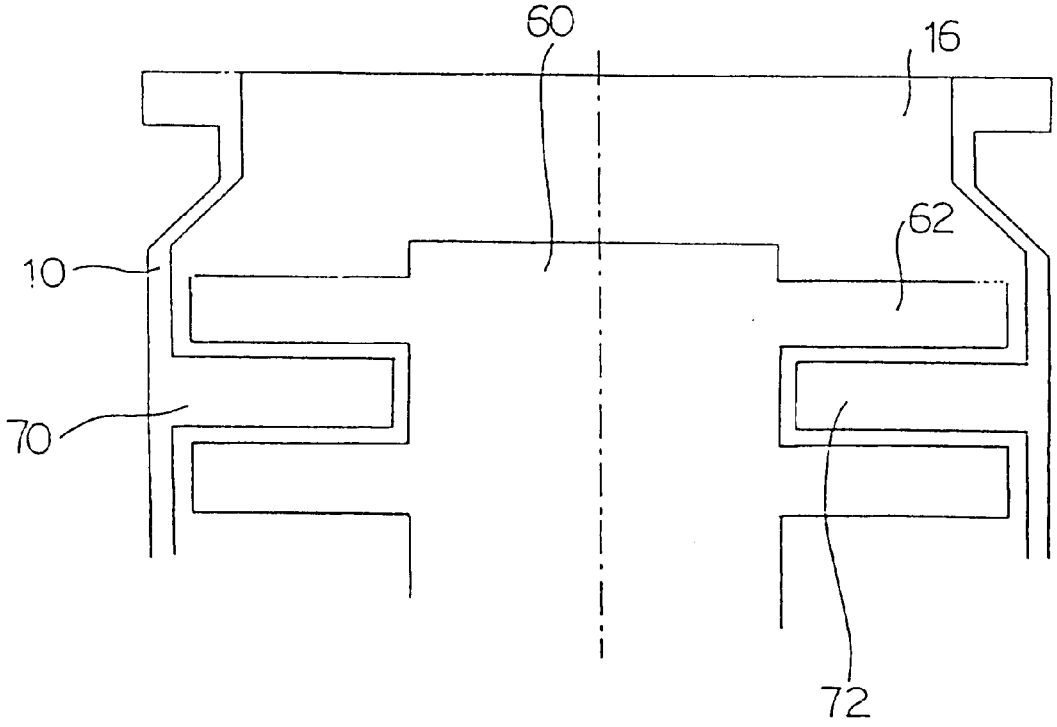
FIG.6C PRIOR ART

Only the upper half portion of the rotor blade 62*b* in a vertical direction is inclined to correspond to the conical portion 13 from the following reasons. In general, the rotor blade 62*b* is designed to set a constant elevation angle from the base to the tip end. For this reason, as shown in FIG. 5, the front surface of the rotor blade 62*b* (the surface toward the downstream) has slight sweep back angle at the upper half portion than the center line D relative to a normal direction and slight angular advance at the lower half portion. Then, the gas molecules impinging on rotor blade 62*b* of the upstream side than the center line D are accelerated outward as indicated by arrows E, F while the gas molecules impinging on the downstream side are accelerated inward as indicated by arrows G. Therefore, the molecules impinging and reflected at the downstream side of the rotor blades are unlikely to impinge on the casing, so that application of the present invention to only the upstream side than the center line D of the rotor blade 62*b* is also effective. This also makes it possible to reduce the length of the conical portion 13 in a vertical direction (to increase an aperture angle), thereby increasing conductance as well as downsizing as a whole.

As described above, the vacuum pump of the present invention can attain less loss at the tip end of the rotor blade arranged on the inlet port side, thus improving discharge capabilities.

What is claimed is:

1. A vacuum pump comprising:

a casing having an inlet port for introducing a gas by suction;

a rotor rotatable disposed in the casing and having plural rotor blades arranged in multiple stages; and a fixed stator disposed in the casing and having plural stator blades disposed between the rotor blades; and wherein the casing includes a cylindrical portion having a larger inner diameter than an inner diameter of the inlet port and a conical portion extending continuously between the cylindrical portion and the inlet port, and each of the rotor blades extends radially outwardly and an uppermost rotor blade proximate the inlet port is located in a position corresponding to the conical portion.

2. A vacuum pump according to claim 1; wherein the shape of a radially outward end of the uppermost rotor blade disposed closest to the inlet port is inclined at the same angle of inclination as the conical portion of the casing.

3. A vacuum pump according to claim 1; wherein a second rotor blade is located in a position corresponding to the conical portion of the casing.

4. A vacuum pump according to claim 1; wherein the uppermost rotor blade has an upper portion positioned in the conical portion of the casing and a lower portion positioned in the cylindrical portion of the casing.

5. A vacuum pump comprising: a casing having an inlet port into which a gas is introduced by vacuum suction; a rotor rotatably disposed in the casing and having a plurality of rotor blades separated from each other in an axial direction of the casing; a motor disposed in the casing for rotatably driving the rotor; and a fixed stator disposed in the casing to oppose the rotor and having a plurality of stator blades arranged between the rotor blades, so that rotational movement of the rotor causes gas introduced at the inlet port to be transported by the rotor blades in an axial direction of the casing away from the inlet port; wherein the casing has a cylindrical portion and a conical portion extending from the cylindrical portion to the inlet port, and at least one of the rotor blades proximate the inlet port has a radially outward end inclined at the same angle of inclination as the conical portion of the casing.

6. A vacuum pump according to claim 5; wherein the at least one rotor blade having the inclined outward end is located in a position corresponding to the conical portion of the casing.

7. A vacuum pump according to claim 5; wherein the cylindrical portion of the casing has an inner diameter larger than that of the inlet port.

8. A vacuum pump according to claim 5; wherein the at least one rotor blade comprises an uppermost rotor blade disposed closest to the inlet port.

9. A vacuum pump according to claim 5; wherein the at least one rotor blade comprises two or more of the uppermost rotor blades disposed closest to the inlet port.

10. A vacuum pump according to claim 5; wherein at least two rotor blades are located in a position corresponding to the conical portion of the casing.

11. A vacuum pump according to claim 5; wherein one of the rotor blades is located so that an upper portion thereof is positioned in the conical portion of the casing and a lower portion thereof is positioned in the cylindrical portion of the casing.

* * * * *